US012734571B2

(12) United States Patent
Shivpuri

(10) Patent No.: US 12,734,571 B2
(45) Date of Patent: Sep. 15, 2026

(54) DIE ASSEMBLY AND METHODS FOR FRICTION STIR EXTRUSION

(71) Applicant: Ohio State Innovation Foundation, Columbus, OH (US)

(72) Inventor: Rajiv Shivpuri, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 420 days.

(21) Appl. No.: 18/478,381

(22) Filed: Sep. 29, 2023

(65) Prior Publication Data

US 2024/0109112 A1 Apr. 4, 2024

Related U.S. Application Data

(60) Provisional application No. 63/411,201, filed on Sep. 29, 2022.

(51) Int. Cl.

| | |
|---|---|
| ***B21C 25/02*** | (2006.01) |
| ***B21C 23/08*** | (2006.01) |
| ***B21C 23/18*** | (2006.01) |

(52) U.S. Cl.

CPC ..... *B21C 25/02* (2013.01); *B21C 23/08* (2013.01); *B21C 23/186* (2013.01)

(58) Field of Classification Search

CPC ..... B21C 23/002; B21C 23/02; B21C 23/08; B21C 23/18; B21C 23/183; B21C 23/186; B21C 23/218; B21C 25/02

See application file for complete search history.

(56) References Cited

U.S. PATENT DOCUMENTS

| | | | | |
|---|---|---|---|---|
| 10,189,063 | B2 | 1/2019 | Lavender et al. | |
| 11,045,851 | B2 | 6/2021 | Joshi et al. | |
| 2014/0283574 | A1 | 9/2014 | Lavender et al. | |
| 2015/0075242 | A1 | 3/2015 | Eller et al. | |
| 2018/0311713 | A1 | 11/2018 | Joshi et al. | |
| 2020/0009626 | A1 | 1/2020 | Whalen et al. | |
| 2021/0053100 | A1 | 2/2021 | Whalen et al. | |
| 2021/0252632 | A1* | 8/2021 | Eller | B21C 25/02 |
| 2021/0379638 | A1 | 12/2021 | Whalen et al. | |
| 2021/0402471 | A1 | 12/2021 | Whalen et al. | |
| 2022/0281005 | A1* | 9/2022 | Kandasamy | B21C 23/00 |

OTHER PUBLICATIONS

Taysom, et al., "Shear assisted processing and extrusion of enhanced strength aluminum alloy tubing", International Journal of Machine Tools & Manufacture 169 (2021) 103798.

(Continued)

*Primary Examiner* — Debra M Sullivan

(74) *Attorney, Agent, or Firm* — Meunier Carlin & Curfman LLC

(57) ABSTRACT

Disclosed herein are devices and methods related to friction stir extrusion. In particular, the present disclosure relates to die assemblies configured for use in a forward friction stir extrusion system and die assemblies configured for use in a backward friction stir extrusion system. The die assemblies in the forward and backward friction stir extrusion systems can include a die piece comprising a sloped surface, wherein at least a portion of the sloped surface is a textured surface.

15 Claims, 5 Drawing Sheets

(56) References Cited

OTHER PUBLICATIONS

Overman, et al., "Homogenization and texture development in rapidly solidified AZ91E consolidated by Shear Assisted Processing and Extrusion (ShAPE)", Materials Science & Engineering A 701 (2017) 56-68.

Abu-Farha, Fadi. "Spiral Friction Stir Processing (SFSP) for the Extrusion of Lightweight Alloy Tubes." International Manufacturing Science and Engineering Conference. vol. 54990. American Society of Mechanical Engineers, 2012.

Li, X., W. Tang, and A. P. Reynolds. "Material flow and texture in friction extruded wire." Friction stir welding and processing VII (2016): 339-347.

Overman, Nicole R., et al. "Microstructure and mechanical properties of a novel rapidly solidified, high-temperature Al-alloy." Materials Characterization 112 (2016): 142-148.

* cited by examiner

DIE ASSEMBLY AND METHODS FOR FRICTION STIR EXTRUSION

RELATED APPLICATION

This U.S. non-provisional application claims priority to, and the benefit of, U.S. Provisional Patent Application No. 63/411,201, filed Sep. 29, 2022, which is incorporated by reference herein in its entirety.

STATEMENT ACKNOWLEDGING GOVERNMENT SUPPORT

This invention was made with government support under grant/contract number N00014-14-2-0002 awarded by the Office of Naval Research. The government has certain rights in the invention.

BACKGROUND

In recent years, there has been an increasing demand for metal-extruded products for a variety of applications. As a result, techniques such as friction stir extrusion (FSE) have gained traction as effective means for producing extruded metal parts. However, conventional methods of friction stir extrusion often require large amounts of force and torque to generate the requisite frictional heat to soften the feedstock material and extrude these metal pieces. This high-force application can disrupt the microstructure of the material used in the extruded piece and lead to degradation of its mechanical properties. Thus, efficiently designed tooling and extrusion methods capable of reducing the large torque applied during the process are needed to consistently generate structurally sound parts. The devices and methods discussed herein address these and other needs.

SUMMARY

In accordance with the purposes of the disclosed devices and methods as embodied and broadly described herein, the disclosed subject matter relates to die assemblies and methods for friction stir extrusion.

Disclosed herein are die assemblies configured for use in a forward friction stir extrusion system, the die assembly comprising: a die piece comprising: a first cylindrical portion having a first radius, a second portion having a second radius, the second radius being larger than the first radius, and a sloped portion extending from the first cylindrical portion to the second portion wherein the sloped portion comprises a sloped surface extending from the first radius to the second radius; wherein the first cylindrical portion, the second portion, and the sloped portion are each coaxially disposed about a rotational axis; and wherein at least a portion of the sloped surface is a textured surface.

Also disclosed herein are die assemblies configured for use in a forward friction stir extrusion system, the die assembly comprising: a die piece comprising an interior wall defining a chamber disposed about a rotational axis, wherein the die piece has: a first end and a second end opposite and axially spaced apart from the first end, a first opening having a first radius towards the first end, and a second opening having a second radius towards the second end, wherein the first radius is larger than the second radius; and wherein at least a portion of the interior wall defines a sloped surface within the chamber, the sloped surface extending inward from the first radius to the second radius, and wherein at least a portion of the sloped surface is a textured surface.

The present disclosure additionally includes die assemblies configured for use in a backward friction stir extrusion system, the die assembly comprising: a die piece comprising: a first end and a second end opposite and spaced apart from the first end, a cylindrical portion disposed towards the first end, and a sloped portion disposed proximal to the second end, wherein the cylindrical portion and sloped portion are coaxially positioned about a rotational axis, wherein the sloped portion defines a sloped surface extending from a first radius towards the first end to a second radius towards the second end, wherein the first radius is larger than the second radius, and wherein at least a portion of the sloped surface is a textured surface.

Also disclosed herein are die assemblies configured for use in a backward friction stir extrusion system, the die assembly comprising: a die piece comprising, a first end and a second end opposite and spaced apart from the first end, a hollow cylindrical portion disposed towards the first end, and a funnel portion disposed proximal to the second end, wherein the hollow cylindrical portion and the funnel portion are coaxially disposed about a rotational axis, the funnel portion having a first opening having a first radius at the second end and a second opening having a second radius towards the first end, wherein the first radius is larger than the second radius, wherein the funnel portion defines a sloped surface extending inwards from the first radius at the first opening to the second radius at the second opening; and wherein at least a portion of the sloped surface is a textured surface.

Additional advantages of the disclosed devices and methods will be set forth in part in the description which follows, and in part will be obvious from the description. The advantages of the disclosed devices and methods will be realized and attained by means of the elements and combinations particularly pointed out in the appended claims. It is to be understood that both the foregoing general description and the following detailed description are exemplary and explanatory only and are not restrictive of the disclosed devices and methods, as claimed.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1:
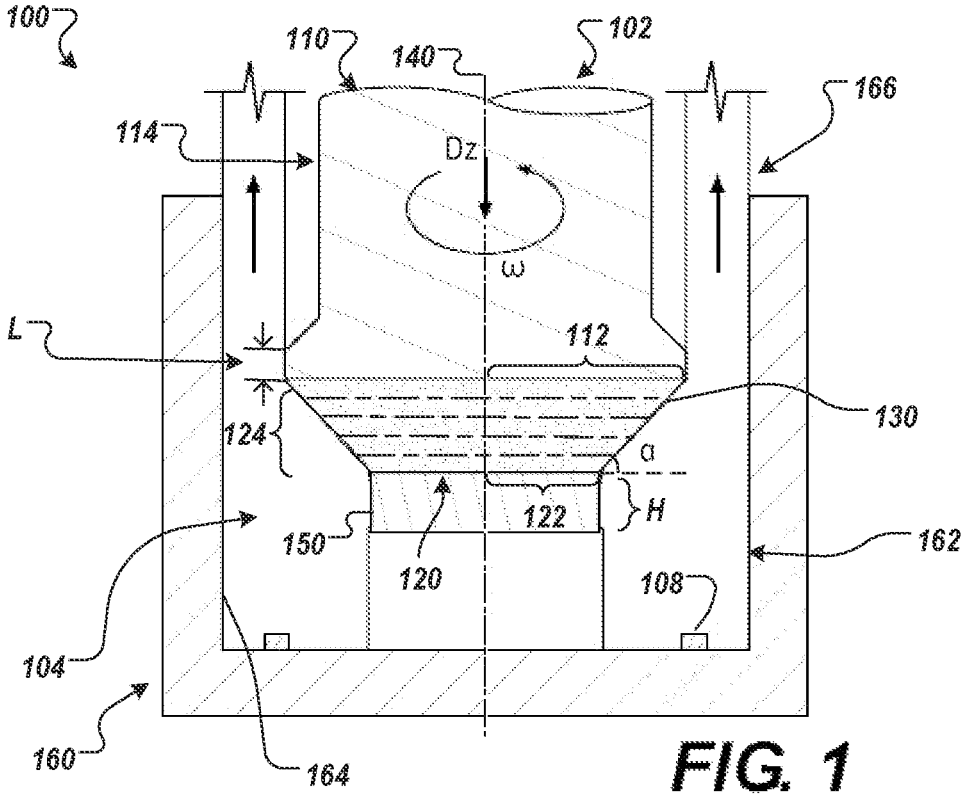
FIG. 1 depicts an example die design configured for use in backward friction stir extrusion (FSE).

The devices and methods described herein may be understood more readily by reference to the following detailed description of specific aspects of the disclosed subject matter and the Examples included therein.

Before the present devices and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

Definitions

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

Values can be expressed herein as an "average" value. "Average" generally refers to the statistical mean or median value.

By "substantially" is meant within 5%, e.g., within 4%, 3%, 2%, or 1%.

"Exemplary" means "an example of" and is not intended to convey an indication of a preferred or ideal embodiment. "Such as" is not used in a restrictive sense, but for explanatory purposes.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

The terms "coupled," "connected," and the like as used herein mean the joining of two members directly or indirectly to one another. Such joining can be stationary (e.g., permanent) or moveable (e.g., removable or releasable). Such joining can be achieved with the two members or the two members and any additional intermediate members being integrally formed as a single unitary body with one another or with the two members or the two members and any additional intermediate members being attached to one another.

Certain terminology is used in the following description for convenience only and is not limiting. The words "right," "left," "lower," and "upper" designate direction in the drawings to which reference is made. The words "inner" and "outer" refer to directions toward and away from, respectively, the geometric center of the described feature or device. The terminology includes the above-listed words, derivatives thereof, and words of similar import.

As used herein, "sloped surface" and the like refers to a non-vertical and non-horizontal surface, typically providing a surface generally oriented off of horizontal or inclining/declining at an angle of from greater than 0° to less than 90°. For example, a sloped surface can be oriented off of horizontal or inclining/declining at an angle of greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, a sloped surface can be oriented off of horizontal or inclining/declining at an angle of less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The angle of the sloped surface can range from any of the minimum values described above to any of the maximum values described above. For example, the sloped surface can be oriented off of horizontal or inclining/declining at an angle of from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°). In some examples, the sloped surface is defined by a linear sloping surface. In some examples, the sloped surface comprises a rounded conical shape. In some examples, the sloped surface comprises a curved surface. In some examples, the sloped surface comprises a continuous curve such as a concave or convex surface. In some examples, the sloped surface defines multiple segments with varying angles and/or curvatures. For example, the sloped surface can include a first segment comprising a linear sloping topography and a second segment defining a curved topography.

As used herein, the term "die piece" refers to a portion of the die assembly that contacts a feedstock material to form a shaped part or article.

Figure 6:
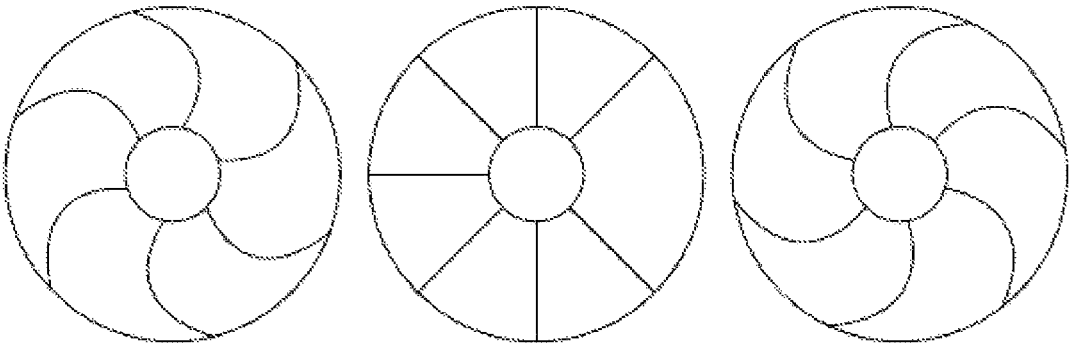
FIG. 6 depicts several example topological features of an example textured surface.

As used herein, the term "textured surface" means a surface including one or more abrasive elements such as ridges, grooves, knurls, teeth, protrusions, grains, and/or otherwise sufficiently broken, uneven, or bumpy elements to generate frictional heat and stir process the feedstock material when rotatably contacted with a feedstock material during the extrusion process. Combinations of the above abrasive elements, such as providing a textured surface having both grooves and grains, can be used to increase the amount of frictional heat produced during the extrusion process to further soften the feedstock material. In some examples, the textured surface can comprise one or more grooves configured to guide the flow of the softened feedstock material along the die surface. In some examples, the one or more grooves can define a spiral scroll shape. Examples of various textured surface configurations are shown in FIG. 6.

Die Assemblies

Disclosed herein are die assemblies configured for use in friction stir extrusion, such as forward stir extrusion and/or backward stir extrusion. The die assemblies can, for example, include a die piece.

For friction stir extrusion of certain high-temperature metals, such as titanium and alloys thereof, nickel and alloys thereof, cobalt and alloys thereof, or combinations thereof, the die assembly can be configured to withstand these high temperatures. In some applications, at least a portion of the die assembly and/or at least a portion of the die piece can be formed from a material having a high melting point, such as tungsten or a tungsten alloy. In some examples, the die piece comprises a material that does not soften or lose its shape at the generated extrusion temperatures and pressures for the requisite application. High-temperature coatings or weld overlays can also be used to protect the die elements from the high temperatures and pressures.

The die pieces and the assembly can be designed to be consistent with the needs for motion, forces, and torques during friction stir extrusion. For example, the die assembly can be used in a friction stir extrusion machine that applies a torque of 5,000 ft-lb or more (e.g., 10,000 ft-lb or more, 15,000 ft-lb or more, or 20,000 ft-lb or more). In some examples, the die can be used in a friction stir extrusion machine that applies a torque of 10,000 ft-lb or less (e.g., 7,500 ft-lb or less, 5,000 ft-lb or less, 3,000 ft-lb or less, 2,000 ft-lb or less, or 1,000 ft-lb or less).

Various ferrous and non-ferrous feedstock materials can be used for friction stir extrusion with the die assemblies disclosed herein such as aluminum and aluminum alloys, titanium and titanium alloys, steels and steel alloys including stainless steels, copper and copper alloys, and super alloys containing nickel, molybdenum, chromium, cobalt, derivatives thereof, or combinations thereof. Some suitable feedstock materials include aluminum alloys such as 6061-Al, 6063-Al, and 7075-Al. In some examples, the feedstock material can comprise a material suitable for construction, automotive, aerospace, and/or nuclear applications. In some examples, the feedstock material can further comprise additional components, for example, to generate a part with certain desired material properties. For example, the feedstock material can further comprise metal matrix composite materials, wherein said metal matrix composite materials can include aluminum oxides, silicon carbides, boron carbides, or a combination thereof. In some examples, the feedstock material can comprise recycled metal scrap, machining chips, powder, or a combination thereof.

In some examples, the die assembly, the die piece, the feedstock material, or a combination thereof can independently be preheated before the friction stir extrusion process begins. In some examples, the die assemblies disclosed herein are not preheated or are only minimally preheated prior to the friction stir extrusion process because adequate frictional heat can be generated within a chamber, such as a weld or extrusion chamber. In some examples, the die assemblies can further comprise one or more thermal channels. The one or more thermal channels can, for example, extend through at least a portion of the die assembly and can be configured to add or remove heat from the die assembly. For example, thermal energy can be added in order to heat the die piece and/or feedstock material prior to or during the friction stir extrusion process. In some examples, the thermal channels can be configured to remove or otherwise dissipate excess heat generated during the friction stir extrusion process.

Figure 4A:
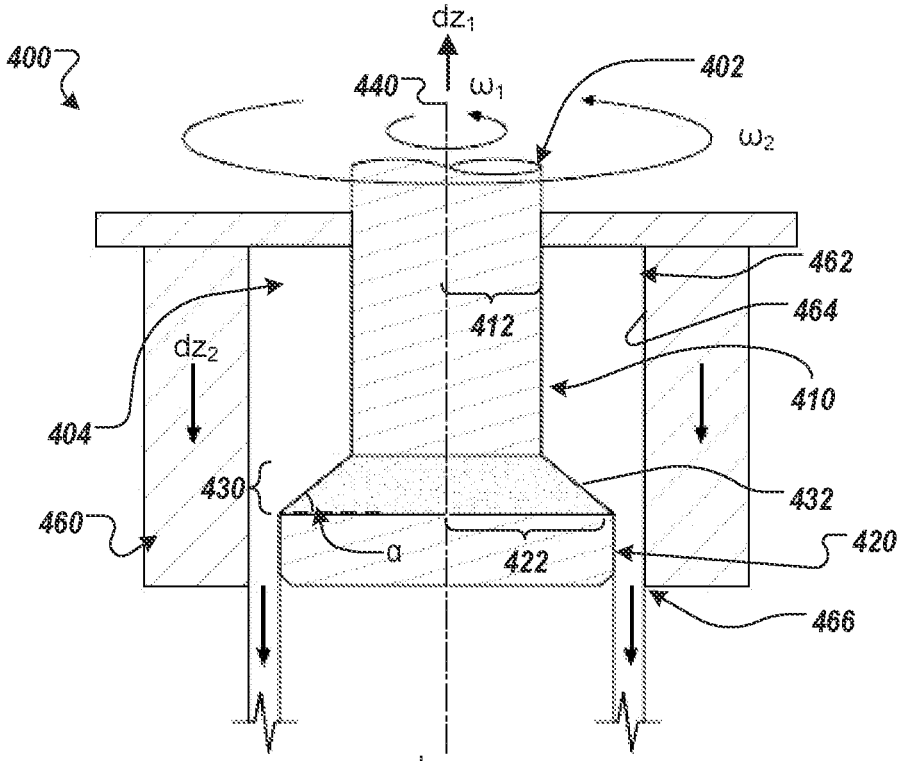
FIG. 4A depicts an example die assembly for use in forward friction stir extrusion for producing a hollow tube product.

Disclosed herein are die assemblies configured for use in a forward friction stir extrusion system. For example, disclosed herein are die assemblies configured for use in a forward friction stir extrusion system. FIG. 4A shows an example of a die assembly 400 comprising a die piece 402 having a first cylindrical portion 410 having a first radius 412, a second portion 420 having a second radius 422, the second radius 422 being larger than the first radius 412. The die piece 402 further includes a sloped portion 430 extending from the first cylindrical portion 410 to the second portion 420 wherein the sloped portion 430 comprises a sloped surface 432 extending from the first radius 412 to the second radius 422. In some examples, the first cylindrical portion 410, the second portion 420, and the sloped portion 430 are each coaxially disposed about a rotational axis 440.

Although the die assembly in FIG. 4A shows a sloped surface 432 having a substantially linear surface, other examples can include sloped surfaces with other features, such as a curved surface or a rounded conical shape. In some examples, at least a portion of the sloped surface 432 is a textured surface. In some examples, the textured surface comprises grooves, spiral scroll engravements, abrasive elements or a combination thereof. In some examples, the textured surface comprises one or more spiral scroll engravements. In some examples, the textured surface can comprise one or more grooves configured to guide the flow of the softened feedstock material along the die surface. In some examples, the one or more grooves can define a spiral scroll shape.

For example, the sloped surface 432 of the sloped portion 430 can be a textured surface having abrasive grains, which can reduce the requisite torque used during the friction stir extrusion process and enhance the microstructural properties of the resulting part.

In some examples, the sloped surface 432 defines a die angle, the die angle being the angle formed by the incline of the sloped surface 432 from the second radius 422 to the first radius 412 relative to the rotational axis 440, for example, indicated as a in FIG. 4A. In some examples, the die angle can be greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, the die angle can be less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The die angle can range from any of the minimum values described above to any of the maximum values described above. For example, the die angle can be from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°).

In some examples, the sloped surface comprises a curved surface. In some examples, the sloped surface comprises a continuous curve such as a concave or convex surface. In some examples, the sloped surface comprises a rounded conical shape.

In some examples, the sloped surface defines multiple segments (segmented die) with varying die angles and/or curvatures. For example, the sloped surface can include a first segment comprising a linear sloping topography and a second segment defining a curved topography. In some examples, the slope surface includes a first segment at a first die angle and a second segment at a second die angle.

In some examples, the die assemblies include the die elements wherein the shape of the extruded material is determined by the configuration or the geometry of these die elements. The die assemblies can include stationary and rotating die pieces that can be chosen to be consistent with the geometry of the extrusion desired. For example, die elements for extruding solids with different cross-sectional shapes can include single or multiple port holes of suitable geometry. In some examples, a die assembly for a hollow extrusion (such as a tube) can include a mandrel in addition to the other die pieces.

In some examples, the die assembly 400 further comprises an extrusion member 460. The extrusion member 460 can, for example, define a substantially cylindrical chamber 462 having an interior wall 464 and an opening 466. The substantially cylindrical chamber 462 can, for example, be configured to receive the die piece 402 and a feedstock material 404 (e.g., a billet). In some examples, the feedstock material 404 is configured to be disposed between the die piece 402 and the interior wall 464 of the substantially cylindrical chamber 462. In some examples, the extrusion member 460 is configured to move axially relative to the die piece 402 (e.g., along the rotational axis 440). In some examples, the die piece 402 and/or the extrusion member 460 is configured to rotate about the rotational axis 440. In some examples, rotation of the die piece 402 and/or the extrusion member 460 and axial displacement of the extrusion member 460 relative to the die piece 402 and the feedstock material 404 is configured to cause the feedstock material 404 to extrude through the opening 466. In some examples, the extrusion member can be configured to be physically coupled to the feedstock material, for example by one or more anchor elements.

The die piece 402 rotates about the rotational axis 440 at a rotation speed ($\omega_1$) and the extrusion member 460 rotates about the rotational axis 440 at a rotation speed ($\omega_2$). The die piece can further move along the rotational axis 440 towards the feedstock material 404 at a displacement rate ($dz_1$) and the extrusion member 460 move along the rotational axis 440 to move the feedstock material 404 towards the die piece 402 at a displacement rate ($dz_2$). In some examples, the rotation speed ($\omega_1$) of the die piece 402 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the rotation speed ($\omega_2$) of the extrusion member 460 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the displacement rate ($dz_1$) of the die piece 402 towards the feedstock 404 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the displacement rate ($dz_2$) of the extrusion member 460 towards the die piece 402 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the rotation speed ($\omega_1$) of the die piece 402 is the same as the rotation speed ($\omega_2$) of the extrusion member 460. In some examples, the displacement rate ($dz_1$) of the die piece 302 is the same as the displacement rate ($dz_2$) of the extrusion member 460. In some examples, the rotation of the die piece 402 is in the same direction as the rotation of the extrusion member 460. In some examples, the rotation of the die piece 402 is in a different direction from the rotation of the extrusion member 460. In some examples, one of the die piece 402 or the extrusion member 460 is stationary.

In some examples, the die assembly can further comprise one or more thermal channels, for example, to assist the die assembly with thermal regulation. The one or more thermal channels can, for example, extend through at least a portion of the die piece and/or the extrusion member such that the one or more thermal channels is configured to add or remove thermal energy adjacent to the die piece. In some examples, the one or more thermal channels are cooling channels configured to remove thermal energy, such as excess heat generated. In some examples, the one or more thermal channels are heating channels configured to add thermal energy to the system. In some examples, a combination of thermal and cooling channels are used. In some examples, each of the one or more thermal channels can independently be controlled by a thermal regulator system.

Figure 2:
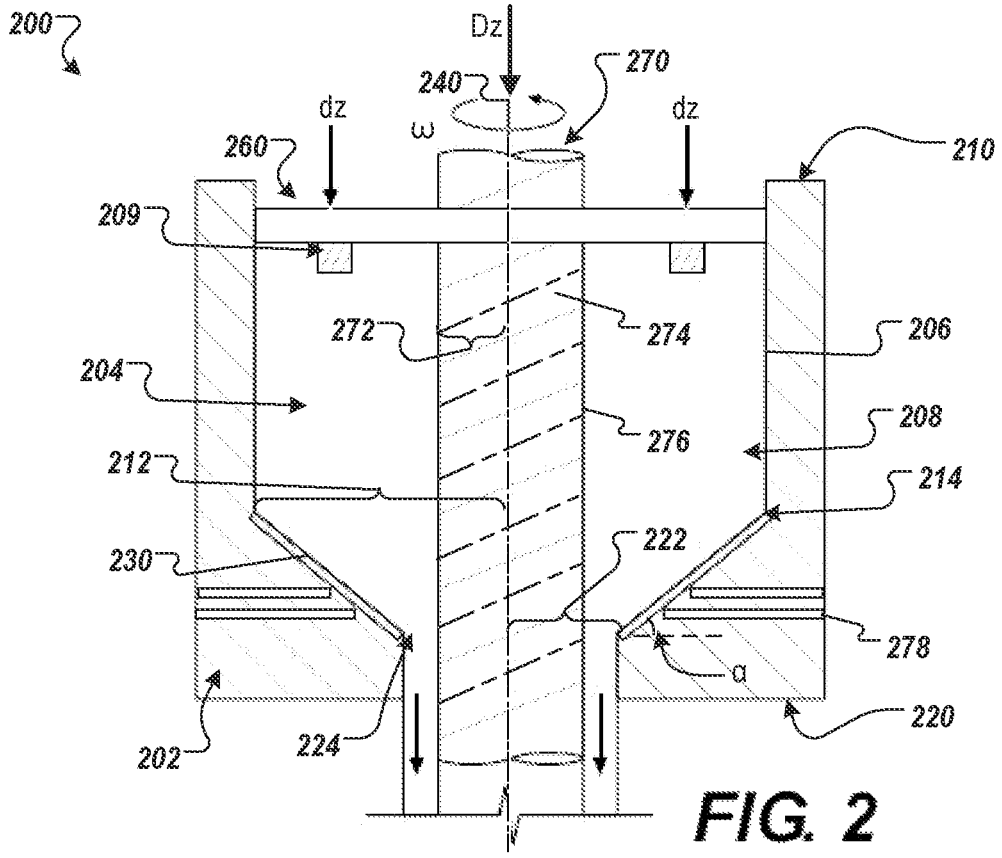
FIG. 2 depicts an example die design configured for use in forward friction stir extrusion. The design includes a die angle of the die surface to facilitate flow and lower load/torque.

In another example, shown in FIG. 2, also disclosed herein are die assemblies 200 configured for use in a forward friction stir extrusion system, wherein the die assembly 200 comprises a die piece 202 having an interior wall 206 that defines a chamber 208 disposed about a rotational axis 240. The die piece 202 comprises a first end 210 and a second end 220 opposite and axially spaced apart from the first end 210. The die piece 202 further comprises a first opening 214 having a first radius 212 towards the first end 210. The die piece 202 further comprises a second opening 224 having a second radius 222 towards the second end 220, wherein the first radius 212 is larger than the second radius 222. At least a portion of the interior wall 206 defines a sloped surface 230 within the chamber 208, the sloped surface 230 extending inward from the first radius 212 to the second radius 222. Although the die assembly in FIG. 2 includes a sloped surface 230 having a substantially linear surface, other examples can include sloped surfaces with other features, such as a curved surface or a rounded conical shape. Moreover, the angle of the incline between the sloped surface 230 extending from the second radius 222 to the first radius 212 can be altered according to any of the die angles disclosed herein.

In some examples, as shown in FIG. 2, at least a portion of the sloped surface 230 is a textured surface. In some examples, the textured surface comprises grooves, spiral scroll engravements, abrasive elements or a combination thereof. In some examples, the textured surface comprises one or more spiral scroll engravements. In some examples, the textured surface can comprise one or more grooves configured to guide the flow of the softened feedstock material along the die surface. In some examples, the one or more grooves can define a spiral scroll shape.

Figure 4B:
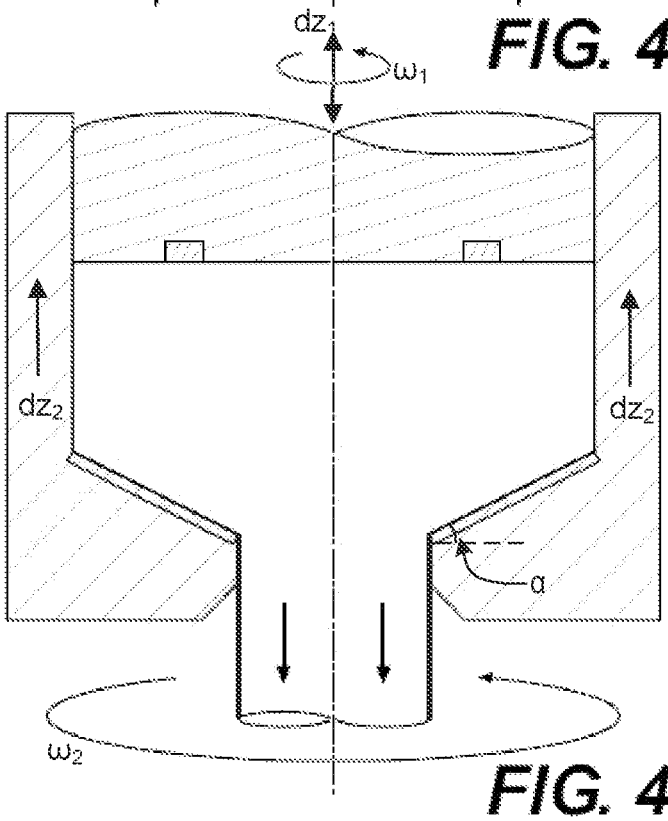
FIG. 4B depicts an example die assembly for use in forward friction stir extrusion for forming a solid cylinder.
Figure 5:
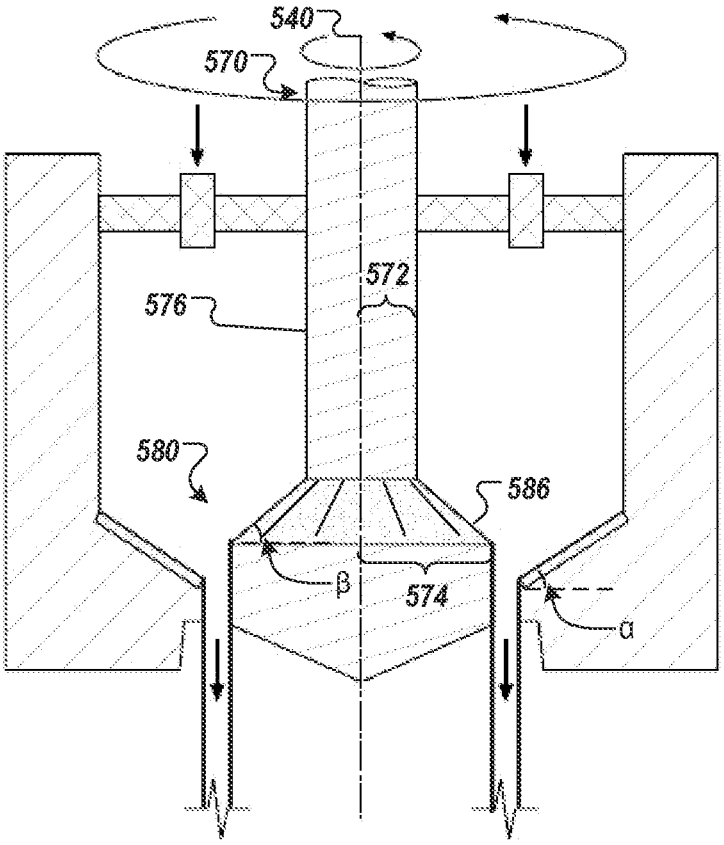
FIG. 5 depicts an example of the die assembly for use in forward friction stir extrusion having a rotating die piece and mandrel.

In some examples, the sloped surface defines a die angle, the die angle being the angle formed by the incline of the sloped surface from the second radius to the first radius relative to the rotational axis, for example, indicated as a in FIG. 2, FIG. 4B, and FIG. 5. In some examples, the die angle can be greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, the die angle can be less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The die angle can range from any of the minimum values described above to any of the maximum values described above. For example, the die angle can be from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°). In some examples, the sloped surface comprises a curved surface. In some examples, the sloped surface comprises a continuous curve such as a concave or convex surface. In some examples, the sloped surface comprises a rounded conical shape.

In some examples, the sloped surface defines multiple segments (segmented die) with varying die angles and/or curvatures. For example, the sloped surface can include a first segment comprising a linear sloping topography and a second segment defining a curved topography. In some examples, the slope surface includes a first segment at a first die angle and a second segment at a second die angle.

In some examples, the die assemblies include the die elements wherein the shape of the extruded material is determined by the configuration or the geometry of these die elements. The die assemblies can include stationary and rotating die pieces that can be chosen to be consistent with the geometry of the extrusion desired. For example, die elements for extruding solids with different cross-sectional shapes can include single or multiple port holes of suitable geometry. In some examples, a die assembly for a hollow extrusion (such as a tube) can include a mandrel in addition to the other die pieces.

In some examples, the die assembly further comprises an extrusion member 260. The extrusion member 260 can, for example, be configured to contact a feedstock material 204.

In some examples, the extrusion member 260, shown as a plunger, is configured to axially move about the rotational axis 240 or displace the feedstock material 204 relative to the die piece 202, such as from the first end 210 of the die piece 202 towards the second end 220 of the die piece 202. In some examples, the extrusion member 260 is coaxially disposed about the rotational axis 240.

In some examples, the die piece 202 and/or the extrusion member 260 are configured to rotate about the rotational axis 240. In some examples, rotation of the die piece 202 and/or the extrusion member 260 and axial displacement of the extrusion member 260 relative to the die piece 202 is configured to cause the feedstock material 204 to extrude through the second opening 224. In some examples, the extrusion member can be configured to be physically coupled to the feedstock material 204, for example by one or more anchor elements 209.

In some examples, the die piece further comprises a mandrel 270 coaxially disposed about the rotational axis 240. The mandrel 270 can, for example, comprise an axially extending cylindrical portion 274 with a third radius 272 and defining a first mandrel surface 276. In some examples, the feedstock material 204 is configured to be disposed between the mandrel 270 and the interior wall 206 of the die piece 202.

Although the mandrel 270 shown in FIG. 2 has a uniform radius along the rotational axis 240, other configurations may also be used. An example die assembly including an example mandrel is shown in FIG. 5. Referring now to FIG. 5, in some examples, the mandrel 570 further includes a sloped portion 580. The cylindrical portion of the mandrel defines a first mandrel surface 576. The sloped portion 580 of the mandrel 570 extends from the third radius 572 to a fourth radius 574 larger than the third radius 572, and wherein the sloped portion of the mandrel defines a second mandrel surface 586. In some examples, the second radius of the die piece can be larger than the fourth radius of the mandrel.

In some examples, the first mandrel surface and/or the second mandrel surface independently comprises a textured surface. For example, the first mandrel surface and/or the second mandrel surface independently comprising a textured surface can increase the amount of frictional heat generated upon rotation of one of the components of the die assembly.

The mandrel 570 in FIG. 5 shows both the first mandrel surface 576 and second mandrel surface 586 having a textured surface, with different textural patterns. However, in other examples, one or neither surface of the mandrel includes a textured surface.

In some examples, the sloped portion 580 of the mandrel comprises a sloped surface, e.g. the second mandrel surface comprises a sloped surface. The second mandrel surface can, for example, form a mandrel angle defined by the incline of the second mandrel surface 586 from the fourth radius to the third radius relative to the rotational axis 540, for example, shown as β in FIG. 5. In some examples, the mandrel angle can have an angle greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, e of less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The mandrel angle can range from any of the minimum values described above to any of the maximum values described above. For example, the mandrel angle can have an angle of from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°).

In some examples, the sloped surface defines multiple segments (segmented mandrel) with varying mandrel angles and/or curvatures. For example, the sloped surface can include a first segment comprising a linear sloping topography and a second segment defining a curved topography. In some examples, the slope surface includes a first segment having a first mandrel angle and a second segment having a second mandrel angle.

In some examples, the mandrel 270 and extrusion member can be configured to rotate about the rotational axis 240. In some examples, rotation of the mandrel 270 and extrusion member 260, optionally rotation of the die piece 202, and axial displacement of the extrusion member 260 relative to the die piece 202 can be configured to cause the feedstock material 204 to extrude through the second opening 224. The mandrel 270 and extrusion member 260 rotate about the rotational axis 240 at a rotation speed (ω). The extrusion member 260 moves along the rotational axis 240 to move the feedstock material 204 towards the die piece 202 at a displacement rate (dz). The mandrel 270 moves along the rotational axis 240 to move the feedstock material 204 towards the die piece 202 at a displacement rate (Dz). In some examples, the rotation speed (ω) of the extrusion member 260 and mandrel 270 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the displacement rate (dz) of the extrusion member 260 towards the feedstock 204 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the displacement rate (Dz) of the mandrel 270 towards the die piece 202 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the displacement rate (dz) of the extrusion member 260 is the same as the displacement rate (Dz) of the mandrel 270. In some examples, the displacement rate (dz) of the extrusion member 260 is different than the displacement rate (Dz) of the mandrel 270.

An example die assembly is shown in FIG. 4B. Die assemblies without a mandrel, such as the one depicted in FIG. 4B, can be used to form solid rods from a billet feedstock.

The die assembly 200 of FIG. 2 further includes thermal channels 278 extending through at least a portion of the die piece 202. Although the thermal channels 278 shown in FIG. 2 extend through the die piece 202, in some examples thermal channels can extend through the die piece and/or the extrusion member such that the one or more thermal channels are configured to add or remove thermal energy adjacent to the die piece. In some examples, the one or more thermal channels 278 are cooling channels configured to remove thermal energy, such as excess heat generated. In other examples, the one or more thermal channels 278 are heating channels configured to add thermal energy to the system. In some examples, a combination of thermal and cooling channels is used. In some examples, each of the one or more thermal channels 278 can independently be controlled by a thermal regulator system (not shown).

Also disclosed herein are die assemblies configured for use in a backward friction stir extrusion system.

FIG. 1 shows an example of a die assembly 100 for use in a backward friction stir extrusion system. The die assembly 100 comprises a die piece 102 having a first end 110 and a second end 120 opposite and spaced apart from the first end 110. The die piece 102 has a cylindrical portion 114 disposed towards the first end 110 and a sloped portion 124 disposed proximal to the second end 120. The cylindrical portion 114 and sloped portion 124 are coaxially positioned about a rotational axis 140. The sloped portion 124 defines a sloped surface 130 extending from a first radius 112 towards the first end 110 to a second radius 122 towards the second end 120, and the first radius 112 is larger than the second radius 122.

In some examples, at least a portion of the sloped surface 130 is a textured surface. In some examples, the textured surface comprises grooves, spiral scroll engravements, abrasive elements or a combination thereof. In some examples, the textured surface comprises one or more spiral scroll engravements. In some examples, the textured surface can comprise one or more grooves configured to guide the flow of the softened feedstock material along the die surface. In some examples, the one or more grooves can define a spiral scroll shape.

For example, the sloped surface 130 shown in FIG. 1 can include a textured surface containing embedded grooves and/or abrasive grains, which can reduce the requisite torque used during the friction stir extrusion process and enhance the microstructural properties of the resulting part. Although the die assembly in FIG. 1 shows a sloped surface 130 having a substantially linear-angled surface, other examples can include sloped surfaces with other features, such as a curved surface or a rounded conical shape.

In some examples, the sloped surface 130 defines a die angle, the die angle being the angle formed by the incline of the sloped surface 130 from the second radius 122 to the first radius 112 relative to the rotational axis 140, for example, indicated as a in FIG. 1. In some examples, the die angle can be greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, the die angle can be less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The die angle can range from any of the minimum values described above to any of the maximum values described above. For example, the die angle can be from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°).

In some examples, the sloped surface comprises a curved surface. In some examples, the sloped surface comprises a continuous curve such as a concave or convex surface. In some examples, the sloped surface comprises a rounded conical shape.

In some examples, the sloped surface defines multiple segments (segmented die) with varying die angles and/or curvatures. For example, the sloped surface can include a first segment comprising a linear sloping topography and a second segment defining a curved topography. In some examples, the slope surface includes a first segment at a first die angle and a second segment at a second die angle.

In some examples, the die assemblies include the die elements wherein the shape of the extruded material is determined by the configuration or the geometry of these die elements. The die assemblies can include stationary and rotating die pieces that can be chosen to be consistent with the geometry of the extrusion desired. For example, die elements for extruding solids with different cross-sectional shapes can include single or multiple port holes of suitable geometry. In some examples, a die assembly for a hollow extrusion (such as a tube) can include a mandrel in addition to the other die pieces.

In some examples, the die assembly 100 further comprises an extrusion member 160 defining a substantially cylindrical housing 162 having an interior wall 164 and an opening 166. The substantially cylindrical chamber 162 can, for example, be configured to receive the die piece 102 and a feedstock material 104 (e.g., a billet). In some examples, the feedstock material 104 is configured to be disposed between the die piece 102 and the interior wall 164 of the substantially cylindrical chamber 162. In some examples, the extrusion member 160 is configured to move axially (e.g., along the rotational axis 140) relative to the die piece 102. In some examples, the die piece 102 and/or the extrusion member 160 can be configured to rotate about the rotational axis 140. In some examples, rotation of the die piece and/or extrusion member and axial displacement of the extrusion relative to the die piece is configured to cause the feedstock material to extrude through the opening. In some examples, the extrusion member 160 can be configured to be physically coupled to the feedstock material 104, for example by one or more anchor elements 108.

In some examples, the die piece 102 is configured to rotate about the rotational axis 140. In some examples, rotation the die piece 102, and/or rotation of the extrusion member 160, and axial displacement of the die piece 102 relative to the extrusion member 160 can be configured to cause the feedstock material 104 to extrude through the opening 166. The die piece 102 rotates about the rotational axis 140 at a rotation speed (ω). The die piece 102 further moves along the rotational axis 140 to move the feedstock material 104 towards the extrusion member 160 at a displacement rate (Dz). In some examples, the rotation speed (ω) of the die piece 102 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the displacement rate (Dz) of the die piece 102 towards the feedstock material 104 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min).

Figure 3A:
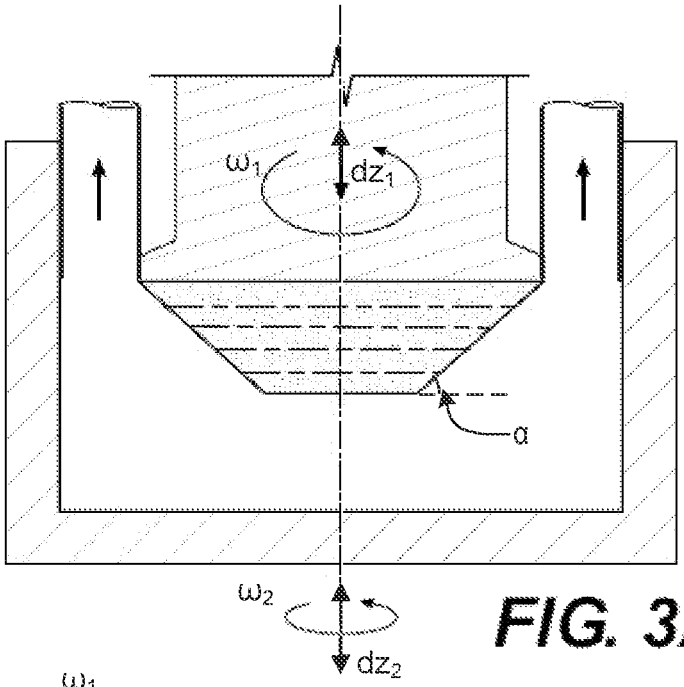
FIG. 3A depicts an example die assembly for use in backward friction stir extrusion for producing a hollow tube-product.

The die piece 102 further includes a plug 150 having a small interference and angled taper, e.g. 5-10°, for initial heat generation. In some examples, a plug is positioned between the material being extruded and the die piece. Plugs can be used to exert pressure and shear forces on the material as it moves through an extrusion chamber, assisting with material flow and shaping. The die assembly of FIG. 3A includes a die piece for backward friction stir extrusion without a plug.

In some examples, the die assembly 100 further comprises one or more thermal channels extending through at least a portion of the die piece and/or the extrusion member such that the one or more thermal channels are configured to add or remove thermal energy adjacent to the die piece. In some examples, the one or more thermal channels are cooling channels configured to remove thermal energy, such as excess heat generated. In other examples, the one or more thermal channels are heating channels configured to add thermal energy to the system. In some examples, a combination of thermal and cooling channels is used. In some examples, each of the one or more thermal channels can independently be controlled by a thermal regulator system.

Figure 3B:
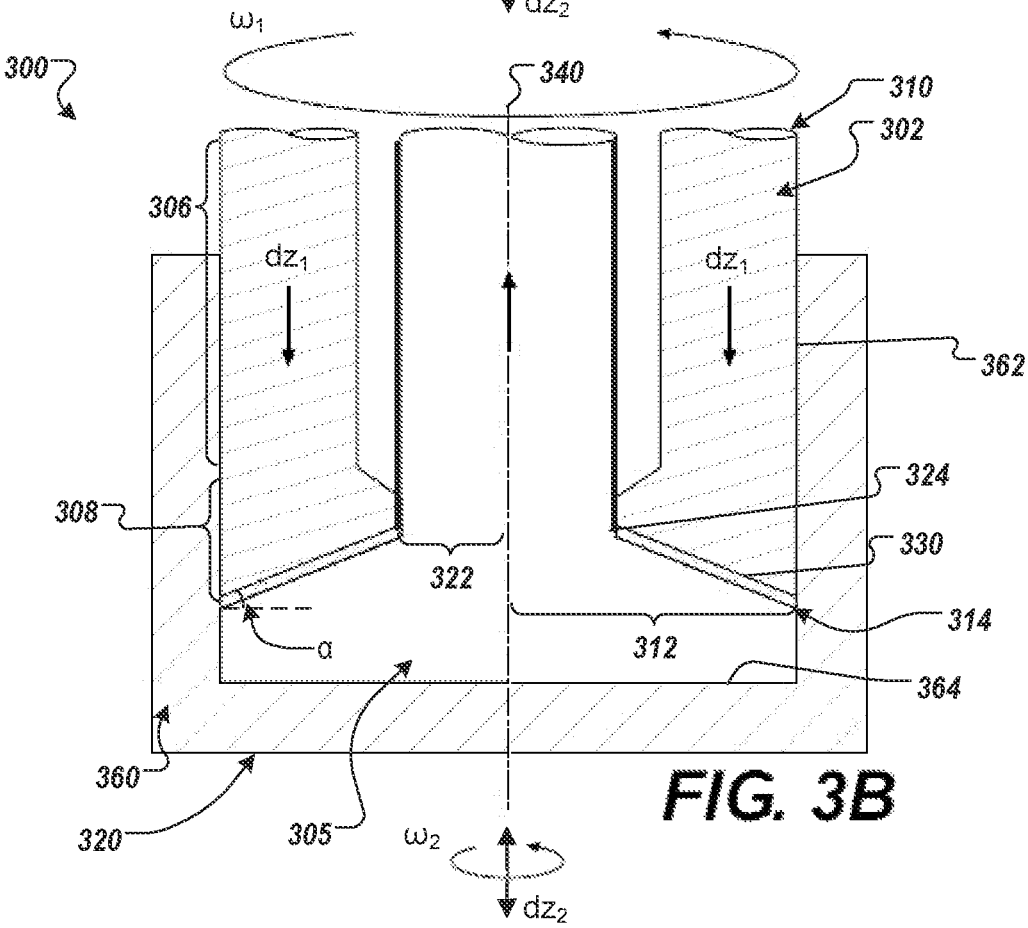
FIG. 3B depicts an example die assembly for use in backward friction stir extrusion for forming a solid cylinder.

FIG. 3B shows another example of a die assembly for use in a backward friction stir extrusion system. The die assembly 300 comprises a die piece 302 having a first end 310 and a second end 320 opposite and spaced apart from the first end 310. The die piece 302 includes a hollow cylindrical portion 306 disposed towards the first end 310 and a funnel portion 308 disposed proximal to the second end 320. The hollow cylindrical portion 306 and the funnel portion 308 are coaxially disposed about a rotational axis 340. The funnel portion 308 has a first opening 314 having a first radius 312 at the second end 320 and a second opening 324 having a second radius 322 towards the first end 310, wherein the first radius 312 is larger than the second radius 322. The funnel portion 308 defines a sloped surface 330 extending inwards from the first radius 312 at the first opening 314 to the second radius 322 at the second opening 324. Although the die assembly in FIG. 3B includes a sloped surface 330 having a substantially linear surface, other examples can include sloped surfaces with other features, such as a curved surface or a rounded conical shape.

In some examples, the die assembly 300 further comprises an extrusion member 360 having a wall defining a hollow cylindrical housing. The hollow cylindrical housing can, for example, comprise a container surface 364, wherein the container surface is substantially normal to the rotational axis 340. The hollow cylindrical housing can be configured to receive the funnel portion 308 of the die piece 302 and a feedstock material 305. The feedstock material 305 is configured to be disposed between the funnel portion 308 of the die piece 302 and the container surface 364. In some examples, the extrusion member is configured to move axially relative to the die piece. In some examples, the die piece and/or the extrusion member is configured to rotate about the rotational axis. In some examples, rotation of the extrusion member 360 and/or die piece 302 and axial displacement of the funnel portion 308 of the die piece 302 relative to the feedstock material 305 is configured to cause the feedstock material 305 to extrude through the second opening 324 towards the first end 310. In some examples, the extrusion member can also be configured to be physically coupled to the feedstock material, for example by one or more anchor elements.

The die piece 302 rotates about the rotational axis 340 at a rotation speed ($\omega_1$) and the extrusion member 360 rotates about the rotational axis 340 at a rotation speed ($\omega_2$). The die piece can further move along the rotational axis towards the feedstock material 305 at a displacement rate ($dz_1$) and the extrusion member 360 move along the rotational axis 340 to move the feedstock material 305 towards the die piece 302 at a displacement rate ($dz_2$). In some examples, the rotation speed ($\omega_1$) of the die piece 302 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the rotation speed ($\omega_2$) of the extrusion member 360 is from 0 rpm to 2500 rpm (e.g., from 0 rpm to 2000 rpm, from 0 rpm to 1500 rpm, from 0 rpm to 1000 rpm, from 0 rpm to 500 rpm, from 0 rpm to 250 rpm, from 250 rpm to 2500 rpm, from 250 rpm to 2000 rpm, from 250 rpm to 1500 rpm, from 250 rpm to 1000 rpm, from 250 rpm to 500 rpm, from 500 rpm to 2500 rpm, from 500 rpm to 2000 rpm, from 500 rpm to 1500 rpm, from 500 rpm to 1000 rpm, or from 1000 rpm to 2000 rpm). In some examples, the displacement rate ($dz_1$) of the die piece 302 towards the feedstock 305 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the displacement rate ($dz_2$) of the extrusion member 360 towards the die piece 302 is from 0 mm/min to 500 mm/min (e.g., from 0 mm/min to 400 mm/min, from 0 mm/min to 300 mm/min, from 0 mm/min to 200 mm/min, from 0 mm/min to 100 mm/min, from 0 mm/min to 50 mm/min, or from 25 mm/min to 75 mm/min). In some examples, the rotation speed of the die piece 302 ($\omega_1$) is the same as the rotation speed of the extrusion member ($\omega_2$). In some examples, the displacement rate of the die piece ($dz_1$) is the same as the displacement rate of the extrusion member ($dz_2$). In some examples, the rotation of the die piece 302 is in the same direction as the rotation of the extrusion member 360. In some examples, the rotation of the die piece 302 is in a different direction as the rotation of the extrusion member 360. In some examples, one of the die piece 302 or the extrusion member 360 is stationary.

In some examples, at least a portion of the sloped surface 330 is a textured surface. In some examples, the textured surface comprises grooves, spiral scroll engravements, abrasive elements or a combination thereof. In some examples, the textured surface comprises one or more spiral scroll engravements. In some examples, the textured surface can comprise one or more grooves configured to guide the flow of the softened feedstock material along the die surface. In some examples, the one or more grooves can define a spiral scroll shape.

In some examples, the sloped surface defines a die angle, the die angle being the angle formed by the incline of the sloped surface from the first radius to the second radius relative to the rotational axis, for example, indicated as a in FIG. 3B. In some examples, the die angle can be greater than 0° (e.g., 1° or more, 2° or more, 3° or more, 4° or more, 5° or more, 10° or more, 15° or more, 20° or more, 25° or more, 30° or more, 35° or more, 40° or more, 45° or more, 50° or more, 55° or more, 60° or more, 65° or more, 70° or more, 75° or more, 80° or more, or 85° or more). In some examples, the die angle can be less than 90° (e.g., 89° or less, 88° or less, 87° or less, 86° or less, 85° or less, 80° or less, 75° or less, 70° or less, 65° or less, 60° or less, 55° or less, 50° or less, 45° or less, 40° or less, 35° or less, 30° or less, 25° or less, 20° or less, 15° or less, 10° or less, or 5° or less). The die angle can range from any of the minimum values described above to any of the maximum values described above. For example, the die angle can be from greater than 0° to less than 90° (e.g., from greater than 0° to 45°, from 45° to less than 90°, from greater than 0° to 30°, from 30° to 60°, from 60° to less than 90°, from greater than 0° to 85°, from greater than 0° to 80°, from greater than 0° to 75°, from greater than 0° to 70°, from greater than 0° to 65°, from greater than 0° to 60°, from greater than 0° to 55°, from greater than 0° to 50°, from greater than 0° to 40°, from greater than 0° to 35°, from greater than 0° to 30°, from greater than 0° to 25°, from greater than 0° to 20°, from greater than 0° to 15°, from 5° to less than 90°, from 10° to less than 90°, from 15° to less than 90°, from 20° to less than 90°, from 25° to less than 90°, from 30° to less than 90°, from 35° to less than 90°, from 40° to less than 90°, from 50° to less than 90°, from 55° to less than 90°, from 60° to less than 90°, from 65 to less than 90°, from 70° to less than 90°, from 75° to less than 90°, from 80° to less than 90°, from 5° to 85°, from 5° to 80°, from 5° to 75°, from 5° to 70°, from 5° to 65°, from 5° to 60°, from 5° to 55°, from 5° to 40°, from 5° to 35°, from 5° to 30°, from 5° to 25°, from 5° to 20°, from 5° to 15°, from 15° to 75°, from 20° to 75°, from 25° to 75°, from 30° to 75°, from 35° to 75°, from 40° to 75°, from 45° to 75°, from 50° to 75°, from 55° to 75°, from 60° to 75°, from 65° to 75°, from 70° to 75°, or from 5° to 75°).

In some examples, the sloped surface comprises a curved surface. In some examples, the sloped surface comprises a continuous curve such as a concave or convex surface. In some examples, the sloped surface comprises a rounded conical shape.

In some examples, the sloped surface defines multiple segments (segmented die) with varying die angles and/or curvatures. For example, the sloped surface can include a first segment comprising a linear sloping topography and a second segment defining a curved topography. In some examples, the slope surface includes a first segment at a first die angle and a second segment at a second die angle.

In some examples, the die assembly 300 includes the die elements wherein the shape of the extruded material is determined by the configuration or the geometry of these die elements. The die assemblies can include stationary and rotating die pieces that can be chosen to be consistent with the geometry of the extrusion desired. For example, die elements for extruding solids with different cross-sectional shapes can include single or multiple port holes of suitable geometry. In some examples, a die assembly for a hollow extrusion (such as a tube) can include a mandrel in addition to the other die pieces.

In some examples, the die assembly 300 further comprises one or more thermal channels extending through at least a portion of the die piece and/or the extrusion member such that the one or more thermal channels are configured to add or remove thermal energy adjacent to the die piece. In some examples, the one or more thermal channels are cooling channels configured to remove thermal energy, such as excess heat generated. In some examples, the one or more thermal channels are heating channels configured to add thermal energy to the system. In some examples, a combination of thermal and cooling channels are used. In some examples, each of the one or more thermal channels can independently be controlled by a thermal regulator system.

Methods of Forming Parts

Also disclosed herein are methods of using any of the die assemblies and/or die pieces disclosed herein, for example, to form an extruded part.

In some examples, the disclosed method comprises a forward friction stir extrusion process. For example, the method can include forming a part using any of the die assemblies configured for forward stir extrusion disclosed herein.

In other examples, the method comprises a backward friction stir extrusion process. For example, the method can include forming a part using any of the die assemblies configured for backward stir extrusion disclosed herein.

In some examples, the method further comprises preheating the feedstock material until substantially at a steady-state by applying localized frictional heat by rotating the extrusion member and/or die piece at a first rotational speed and axially moving the extrusion member relative to the die piece at a first plunger rate. The methods can further comprise modifying the rotational speed and/or the plunger rate.

For example, the methods can further comprise decreasing the rotational speed from the first rotation speed to a second rotational speed, wherein the second rotational speed is lower than the first rotational speed.

For example, the second rotational speed can be 75% or less of the first rotational speed (e.g., 70% or less of the first rotational speed, 65% or less of the first rotational speed, 60% or less of the first rotational speed, 55% or less of the first rotational speed, 50% or less of the first rotational speed, 45% or less of the first rotational speed, 40% or less of the first rotational speed, 35% or less of the first rotational speed, 30% or less of the first rotational speed, or 25% or less of the first rotational speed).

In some examples, the methods can further comprise increasing the plunger rate from the first plunger rate to a second plunger rate, wherein the second plunger rate is higher than the first plunger rate. For example, the second plunger rate can be higher than the first plunger rate by 10% or more (e.g., 15% or more, 20% or more, 25% or more, 30% or more, 35% or more, 40% or more, 45% or more, 50% or more, 55% or more, 60% or more, 65% or more, 70% or more, 75% or more, or 80% or more).

A number of embodiments of the invention have been described. Nevertheless, it will be understood that various modifications can be made without departing from the spirit and scope of the invention. Accordingly, other embodiments are within the scope of the following claims.

The examples below are intended to further illustrate certain aspects of the devices and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of measurement conditions, e.g., component concentrations, temperatures, pressures and other measurement ranges and conditions that can be used to optimize the described process.

Example 1

Friction stir extrusion (FSE) is a recent development that enables hot extrusion without the need to preheat the starting billet. It results in significant savings in thermal energy, and improves the mechanical properties of the extruded part (e.g., by providing smaller grain sizes). However, current FSE systems often require high starting forces and torques. Described herein are die assemblies and a streamlined die design approach for friction stir extrusion. For example, the die assemblies described herein can reduce force and torque requirements by optimizing the metal flow. In addition, these die assemblies can have a larger die-metal contacting interface that can enhance heat generation and transfer during the friction stir extrusion process.

FIG. 1 depicts an example die design used in backward friction stir extrusion. The design includes a plug with a small interference and taper, e.g., 5-10°, for initial heat generation. The design further includes a conical extrusion and heating zone (extrusion-stir). The length (shown as "L" in FIG. 1) and relief sections (shown as "H" in FIG. 1) can be designed per warm forging guidelines. The inclusion of these elements can be provided to further enhance the microstructure properties of the resulting piece by reducing downstream friction and facilitating material flow. In some examples, the friction stir extrusion process includes: 1) initial indentation and heating (small Dz (die displacement) and high ω (die rotation angle), and 2) steady-state process (optimal Dz and ω).

In some examples, the die assemblies disclosed herein are designed for forward/direct friction stir extrusion. FIG. 2 depicts an example die assembly 200 used in forward friction stir extrusion. The design includes a die angle (α) of the sloped surface 230 to facilitate flow and lower load/torque. The die assembly 200 further includes a rough mandrel 270 (directional), which can be stationary or rotational. In some examples, the die piece 202 is rotational about the rotational axis 240. In some examples, both the die piece 202 and the rough mandrel 270 are rotational about the rotational axis 240. The die assembly 200 can further include a billet 204 (feedstock) anchored to a plunger 260 that displaces/indents and/or rotates. Friction stir extrusion using the die assembly 200 can include rotation of the mandrel 270 and/or die 202 at a rotational speed (ω in FIG. 2) and translation of the mandrel 270 and plunger 260 at a displacement rate (e.g., Dz and dz, respectively, in FIG. 2) along the rotational axis 240. In some examples, the friction stir extrusion process can include two steps: 1) high rotation and small indentation (slow Dz) to preheat the material close to the die, and 2) steady state extrusion (tube extrudes from exit).

Other advantages which are obvious and which are inherent to the invention will be evident to one skilled in the art. It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The devices and methods of the appended claims are not limited in scope by the specific devices and methods described herein, which are intended as illustrations of a few aspects of the claims and any devices and methods that are functionally equivalent are intended to fall within the scope of the claims. Various modifications of the devices and methods in addition to those shown and described herein are intended to fall within the scope of the appended claims. Further, while only certain representative method steps disclosed herein are specifically described, other combinations of the method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

What is claimed is:

1. A die assembly configured for use in a forward friction stir extrusion system, the die assembly comprising:

a die piece comprising:

a first cylindrical portion having a first radius, a second portion having a second radius, the second radius being larger than the first radius, and a sloped portion extending from the first cylindrical portion to the second portion, wherein the sloped portion comprises a sloped surface extending from the first radius to the second radius;

wherein the first cylindrical portion, the second portion, and the sloped portion are each coaxially disposed about a rotational axis; and wherein at least a portion of the sloped surface is a textured surface; and an extrusion member defining a substantially cylindrical chamber having an interior wall and an opening; wherein the substantially cylindrical chamber is configured to receive the die piece and a feedstock material; wherein the extrusion member is configured to move axially relative to the die piece; and wherein the feedstock material is configured to be disposed between the die piece and the interior wall of the substantially cylindrical chamber.

2. The die assembly of claim 1, wherein:

the die piece and/or the extrusion member is configured to rotate about the rotational axis;

the extrusion member is configured to move axially relative to the die piece; and rotation of the die piece and/or the extrusion member and axial displacement of the extrusion member relative to the die piece and the feedstock material is configured to cause the feedstock material to extrude through the opening.

3. The die assembly of claim 1, further comprising one or more thermal channels extending through at least a portion of the die piece and/or the extrusion member such that the one or more thermal channels are configured to add or remove thermal energy adjacent to the die piece.

4. The die assembly of claim 1, wherein the textured surface comprises grooves, spiral scroll engravements, abrasive elements, or a combination thereof.

5. A die assembly configured for use in a forward friction stir extrusion system, the die assembly comprising:

a die piece comprising an interior wall defining a chamber disposed about a rotational axis, wherein the die piece comprises:

a first end and a second end opposite and axially spaced apart from the first end, a first opening having a first radius towards the first end, and a second opening having a second radius towards the second end, wherein the first radius is larger than the second radius; and wherein at least a portion of the interior wall defines a sloped surface within the chamber, the sloped surface extending inward from the first radius to the second radius, and wherein at least a portion of the sloped surface is a textured surface; and a mandrel coaxially disposed about the rotational axis, the mandrel comprising an axially extending cylindrical portion having a third radius and defining a first mandrel surface, wherein the feedstock material is configured to be disposed between the mandrel and the interior wall of the die piece.

6. The die assembly of claim 5, further comprising an extrusion member configured to contact a feedstock material, wherein the extrusion member is configured to axially move the feedstock material from the first end of the die piece towards the second end of the die piece.

7. The die assembly of claim 6, wherein:

the die piece and/or the extrusion member is configured to rotate about the rotational axis;

the extrusion member is configured to move axially relative to the die piece; and rotation of the die piece and/or the extrusion member and axial displacement of the extrusion member relative to the die piece is configured to cause the feedstock material to extrude through the second opening.

8. The die assembly of claim 5, wherein the mandrel further comprises a sloped portion, wherein the sloped portion of the mandrel extends from the third radius to a fourth radius larger than the third radius, and wherein the sloped portion of the mandrel defines a second mandrel surface.

9. A die assembly configured for use in a backward friction stir extrusion system, the die assembly comprising:

a die piece comprising:

a first end and a second end opposite and spaced apart from the first end, a cylindrical portion disposed towards the first end, and a sloped portion disposed proximal to the second end, wherein the cylindrical portion and sloped portion are coaxially positioned about a rotational axis, wherein the sloped portion defines a sloped surface extending from a first radius towards the first end to a second radius towards the second end, wherein the first radius is larger than the second radius, and wherein at least a portion of the sloped surface is a textured surface; and an extrusion member defining a substantially cylindrical housing having an interior wall and an opening; wherein the substantially cylindrical housing is configured to receive the die piece and a feedstock material; and wherein the feedstock material is configured to be disposed between the die piece and the interior wall of the substantially cylindrical housing, wherein the extrusion member is configured to move axially relative to the die piece; wherein the die piece and/or the extrusion member is configured to rotate about the rotational axis; and wherein rotation of the die piece and/or extrusion member and axial displacement of the extrusion relative to the die piece is configured to cause the feedstock material to extrude through the opening.

10. The die assembly of claim 9, further comprising one or more thermal channels extending through at least a portion of the die piece and/or the extrusion member such that the one or more thermal channels are configured to add or remove thermal energy adjacent to the die piece.

11. The die assembly of claim 9, wherein the textured surface comprises grooves, spiral scroll engravements, abrasive elements, or a combination thereof.

12. A die assembly configured for use in a backward friction stir extrusion system, the die assembly comprising:

a die piece comprising, a first end and a second end opposite and spaced apart from the first end, a hollow cylindrical portion disposed towards the first end, and a funnel portion disposed proximal to the second end, wherein the hollow cylindrical portion and the funnel portion are coaxially disposed about a rotational axis, the funnel portion having a first opening having a first radius at the second end and a second opening having a second radius towards the first end, wherein the first radius is larger than the second radius, wherein the funnel portion defines a sloped surface extending inwards from the first radius at the first opening to the second radius at the second opening; and wherein at least a portion of the sloped surface is a textured surface; and an extrusion member having a wall defining a hollow cylindrical housing, wherein the hollow cylindrical housing comprises a container surface that is substantially normal to the rotational axis, wherein the hollow cylindrical housing is configured to receive the funnel portion of the die piece and a feedstock material, and wherein the feedstock material is configured to be disposed between funnel portion of the die piece and the container surface such that rotation of the extrusion member and/or die piece and axial displacement of the funnel portion of the die piece relative to the feedstock material is configured to cause the feedstock material to extrude through the second opening towards the first end.

13. The die assembly of claim 12, further comprising one or more thermal channels extending through at least a portion of the die piece and/or the extrusion member such that the one or more thermal channels are configured to add or remove thermal energy adjacent to the die piece.

14. The die assembly of claim 12, wherein the textured surface comprises grooves, spiral scroll engravements, abrasive elements, or a combination thereof.

15. The die assembly of claim 12, wherein the die piece and/or the extrusion member is configured to rotate about the rotational axis and the extrusion member is configured to move axially relative to the die piece.

* * * * *